US007637305B2

(12) United States Patent
Dubay

(10) Patent No.: US 7,637,305 B2
(45) Date of Patent: Dec. 29, 2009

(54) TWO-STAGE SNAP CAM SYSTEM FOR CASTING AND MOLDING

(76) Inventor: Richard L. Dubay, 11748 Crocus St., Coon Rapids, MN (US) 55733

( * ) Notice: Subject to any disclaimer, the term of this patent is extended or adjusted under 35 U.S.C. 154(b) by 560 days.

(21) Appl. No.: 11/516,959

(22) Filed: Sep. 7, 2006

(65) Prior Publication Data

US 2008/0060782 A1 Mar. 13, 2008

(51) Int. Cl.
*B22D 17/24* (2006.01)
*B22D 33/04* (2006.01)

(52) U.S. Cl. ..... 164/340; 164/342

(58) Field of Classification Search ..... 164/339, 164/340, 341, 342, 137; 74/53
See application file for complete search history.

(56) References Cited

U.S. PATENT DOCUMENTS

| | | | | |
|---|---|---|---|---|
| 2,890,488 | A | 6/1959 | Gemberling | |
| 3,892,508 | A | 7/1975 | Hodler | |
| 3,932,085 | A * | 1/1976 | Horbach | 425/186 |
| 4,027,726 | A | 6/1977 | Hodler | |
| 4,153,231 | A | 5/1979 | Hayakawa et al. | |
| 4,359,443 | A | 11/1982 | Michaels | |
| 4,828,479 | A | 5/1989 | Pleasant | |
| 5,012,568 | A | 5/1991 | DiSimone et al. | |
| 5,263,532 | A | 11/1993 | Kawaguchi et al. | |
| 5,350,289 | A | 9/1994 | Martin | |
| 5,360,049 | A | 11/1994 | Rowe | |
| 5,533,564 | A | 7/1996 | Alberola et al. | |
| 5,562,150 | A | 10/1996 | Shimmell | |
| 5,690,159 | A | 11/1997 | Mizukusa | |
| 5,913,355 | A | 6/1999 | Muramatsu | |
| 5,913,356 | A | 6/1999 | Muramatsu | |
| 6,116,891 | A | 9/2000 | Starkey | |
| 6,431,254 | B2 | 8/2002 | Dittrich | |
| 6,443,723 | B1 | 9/2002 | Buttigieg | |
| 6,591,893 | B1 | 7/2003 | Ratte et al. | |
| 6,634,411 | B2 | 10/2003 | Hirano et al. | |
| 6,637,498 | B1 | 10/2003 | Macheske et al. | |
| 2002/0100860 | A1 | 8/2002 | Wieder | |
| 2002/0127292 | A1 | 9/2002 | Gallinotti et al. | |
| 2005/0098295 | A1 * | 5/2005 | Dubay | 164/312 |
| 2005/0121166 | A1 * | 6/2005 | Dubay | 164/342 |

OTHER PUBLICATIONS

Versa-Slide (Micro) Hardened & Ground catalog, pp. 4-1 and 4-2, (2003).

(Continued)

*Primary Examiner*—Kevin P Kerns
(74) *Attorney, Agent, or Firm*—Kinney & Lange, P.A.

(57) ABSTRACT

A slide assembly for use in a molding or casting system includes a cam pin, a slide base and a core slide. The cam pin includes a head for securing with a first die half, and a two-stage shank extending from the head. The slide base is mountable to a second die half and the core slide is slidably engaged with the slide base. The core slide includes a core pin for extending into a die cavity of the molding or casting system, and a cam pin slot for receiving the two-stage shank of the cam pin such that one-speed relative motion between the cam pin and the slide base produces a two-speed relative motion between the core slide and the slide base.

19 Claims, 7 Drawing Sheets

OTHER PUBLICATIONS

Progressive Components catalog, pp. C-16, C-19-C30, (2003).
Web site www.ngkmetals.com/chillcust.html, printed Jan. 16, 2004.
Web site www.ngkmetals.com/chilladvn.html, printed Jan. 16, 2004.
Web site www.ngkmetals.com/chillvent.html, printed Jan. 16, 2004.
G.L. Wilson, "Improvements in the Hot Chamber Die Casting Process Through Hot-Sprue Technology", pp. 10/1-10/5 (2005).
D-M-E Company, "D-M-E Standard Runner Spreaders and Brushings Exclusively for Zinc Die Casting", North American Digital Catalog, pp. F-15-F-24, J, K, L16, L17, and P1 (2005).

* cited by examiner

TWO-STAGE SNAP CAM SYSTEM FOR CASTING AND MOLDING

BACKGROUND OF THE INVENTION

Die casting and injection molding are popular methods for manufacturing articles from metallic alloys, plastics, synthetic materials and other manufacturing materials, especially for thin walled and small parts. In hot chamber die casting, for example, molten zinc or magnesium is pushed from a crucible, or pot, into a die casting system through a nozzle. The molten metal enters the die casting system through a sprue where it then travels through a runner system before entering the die or mold cavity. Injection molding and die casting generally incorporate two-stage systems comprising a stationary die half and a movable die half, between which is located the die cavity. The stationary die half is fixed in position and includes a first portion of the die cavity into which plastic or molten metal is injected into for curing or solidification. The movable die half moves relative to the stationary die half and includes a second portion of the die cavity that mates with the first portion such that the article can be formed. Typically such articles include hollowed regions or complex features such as contouring or texturing. In order to create these features, it is necessary to insert a core object into the die cavity to produce a void. During a molding or casting cycle, the movable die half mates with the stationary die half whereby the manufacturing material can be injected into the cavity to produce an article having the shape of the cavity, including the void. After solidification or curing, the movable die half retracts from the stationary die half so that the manufactured article can be removed, whereby it is also necessary to remove the core object from the manufactured article.

In some injection molding and die casting systems, a slide assembly is used to produce the internal features within the cavity. In a slide assembly, the core object typically comprises a core pin, or another such projection, that extends into the die cavity from within either the stationary or movable die half. In slide assemblies, the relative movement of the die halves is used to pull the core pin from the die cavity. Typically, the slide assembly includes an angled cam pin that pushes and pulls the core pin in one direction as the die halves are moved in a perpendicular direction. In other words, the one-way or vertical motion of the die halves is translated into a perpendicular or lateral motion to move the core pin. As the die halves are brought together, the slide assembly pushes the core pin into the cavity such that the manufacturing material will form around it to produce the void or contour. After completion of the injection process, the core pin is pulled out of the manufactured article as the die halves separate such that the manufactured article can be removed from the cavity. In order to ensure full withdrawal of the core pin, the length of stroke of the core pin is directly proportional to the angle of the cam pin. However, the greater the angle of the cam pin, the more stress is produced in the cam pin as the die halves are pulled apart, thus resulting in a high occurrence of breakage. Typical slide assemblies are therefore limited in their stroke lengths, which limits the size of the feature that can be produced in the die cavity. As such, there is a need for improved slide assemblies.

BRIEF SUMMARY OF THE INVENTION

The present invention is directed toward a slide assembly for use in a molding or casting system. The slide assembly comprises a cam pin, a slide base and a core slide. The cam pin comprises a head for securing with a first die half, and a two-stage shank extending from the head. The slide base is mountable to a second die half and the core slide is slidably engaged with the slide base. The core slide comprises a core pin for extending into a die cavity of the molding or casting system, and a cam pin slot for receiving the two-stage shank of the cam pin such that one-speed relative motion between the cam pin and the slide base produces a two-speed relative motion between the core slide and the slide base.

DETAILED DESCRIPTION

Figure 1:
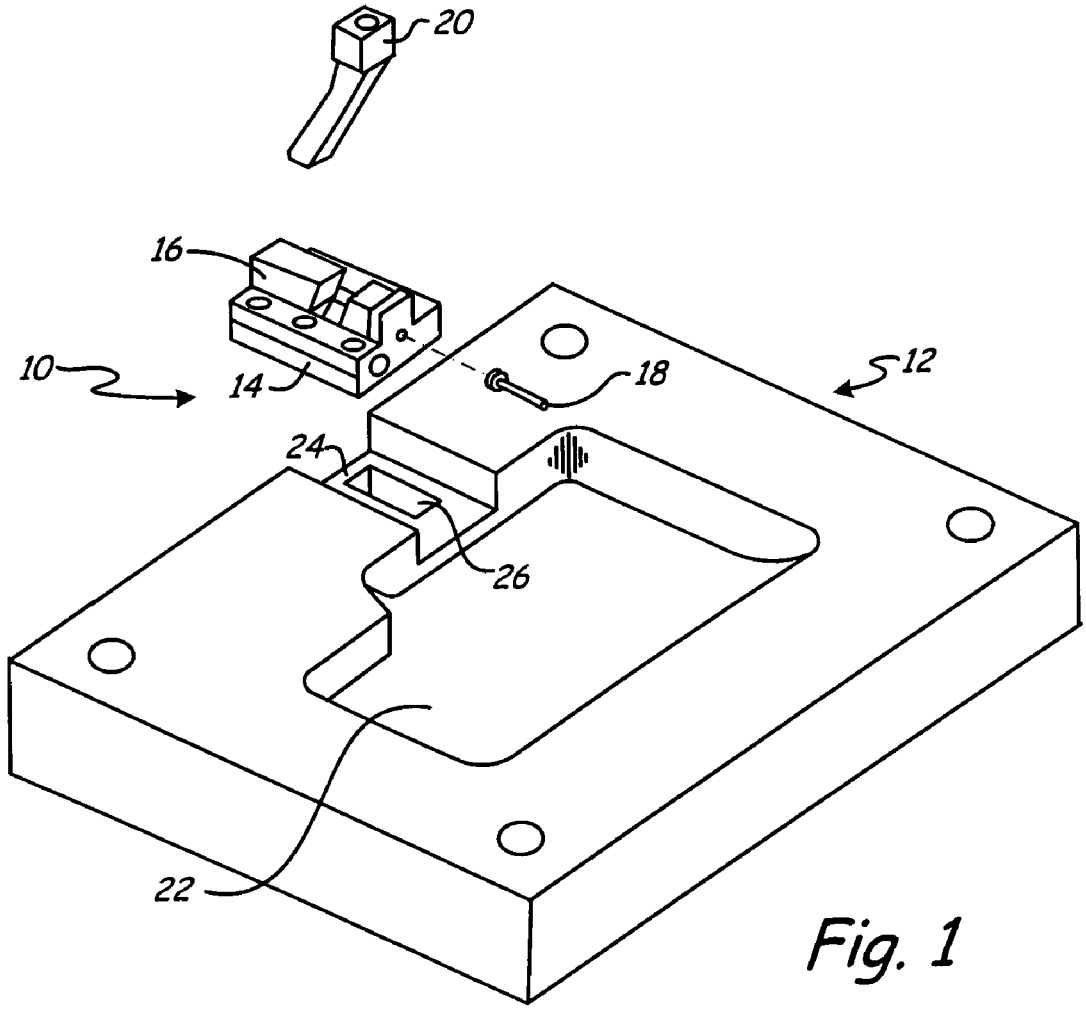
FIG. 1 shows an exploded view of a movable die half and a slide assembly of the present invention for use in casting and molding systems.

FIG. 1 shows an exploded view of slide assembly 10 of the present invention and movable die half 12 for use in casting and molding systems. Slide assembly 10 includes slide base 14, core slide 16, core pin 18 and two-stage cam pin 20. Movable die half 12 includes cavity 22, slide assembly seat 24 and pin slot 26. In typical casting and molding systems, movable die half 12 is mated with a stationary die half (not shown) such that cavity 22 is aligned with a mating cavity, to form a die or mold cavity. As such, manufacturing material, such as molten metal or plastic, can be introduced into cavity 22 to produce an article matching the shape of cavity 22. Slide assembly 12 works in conjunction with movable die half 12 and the stationary die half to produce a void, or hollow region within cavity 22. Slide assembly seat 24 receives slide base 14 when slide assembly 10 is assembled with movable die half 12. Core slide 16 is slidably positioned on slide base 14 and includes core pin 18, which is shown exploded from core slide 16. Cam pin 20 is typically secured to the stationary die half such that it aligns with core slide 16. When cam pin 20 is not inserted into core slide 16, for example when the stationary die half is not engaged with movable die half 12 before cavity 22 is filled with a manufacturing material, core pin 18 is withdrawn into slide base 14. In order to fabricate an article within cavity 22, movable die half 12 is brought into contact with the stationary die half so that the manufacturing material can be introduced into cavity 22. As such, cam pin 20 engages core slide 16 in order to extend core pin 18 into cavity 22 so that a void or feature can be produced in the manufactured article. Cam pin 20 typically extends through core slide 16 and slide base 14 such that it extends into pin slot 26 in movable die half 12.

Figure 2:
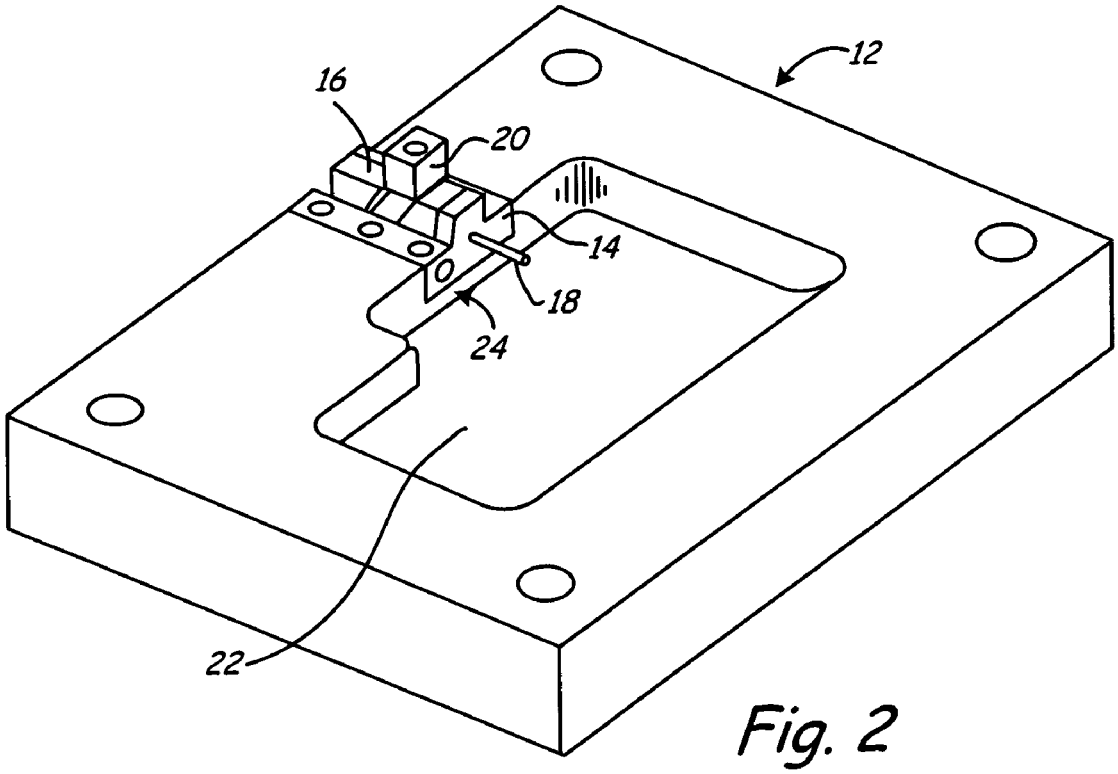
FIG. 2 shows a perspective view of a slide assembly seated within a movable die half.

FIG. 2 shows a perspective view of slide assembly 10 assembled with movable die half 12. As movable die half 12 is brought into contact with the stationary die half, cam pin 20 is inserted into core slide 16, translating core slide 16 toward cavity 22 on slide base 14. As this occurs, core pin 18 is extended into cavity 22 such that a void is produced within an article fabricated within cavity 22. Core pin 18 is shown having a cylindrical cross section as used to make a circular bore in the article of manufacture. In other embodiments, however, core pin 18 comprises various other cross sections, tapering, shapes, contours and engravings, depending on the desired shape of the void to be produced in the manufactured article, so long as it can be pulled from within a solidified article formed in cavity 22. For example, square or rectangular projections having an engraved picture on one face can be used. Once the manufactured article is cured or set within cavity 22, it must be removed so that the manufacturing process can be repeated and the manufactured article can be utilized for its intended purpose. In order to do so, movable die half 12 must be retracted from the stationary die half to allow access to the manufactured article, and core pin 18 must be withdrawn from the manufactured article so that it can freely be removed from die half 12. Utilizing slide assembly 10, these two requirements can be achieved simultaneously using the movement of movable die half 12. As the moveable die half is pulled away from movable die half 12, cam pin 20 is withdrawn from core slide 16, translating core slide 16 away from cavity 22 on slide base 14 in a two-stage manner. As such core pin 18 is withdrawn from cavity 22 with a reduced risk of damaging cam pin 20.

In order to produce longer or deeper voids within cavity 22, core pin 18 must be also be longer or deeper. This correspondingly requires that core pin 18 be pulled further back from cavity 22 in order to allow for removal of the manufactured article. This, in turn, requires that cam pin 20 have a larger cam action or stroke. The cam action or stroke is typically increased by increasing the angle of the shank of the cam pin, which also increases the amount of stress within the cam pin as movable die half 12 is pulled away from the stationary die half. Thus, slide assembly 10 is provided with two-stage cam pin 20 having a two-stage, or dual-angle cam shank to reduce stress in and increase the stroke of cam pin 20.

Figure 3A:
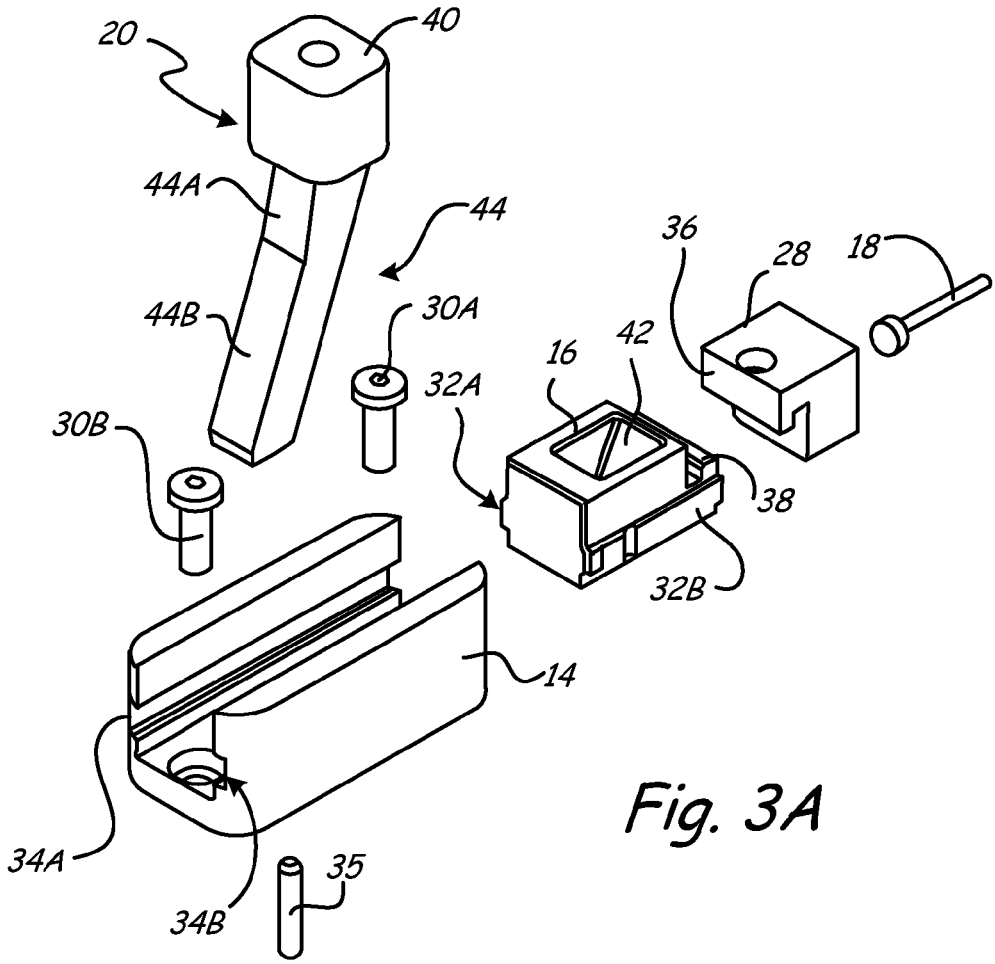
FIG. 3A shows an exploded view of a slide assembly of the present invention.
Figure 3B:
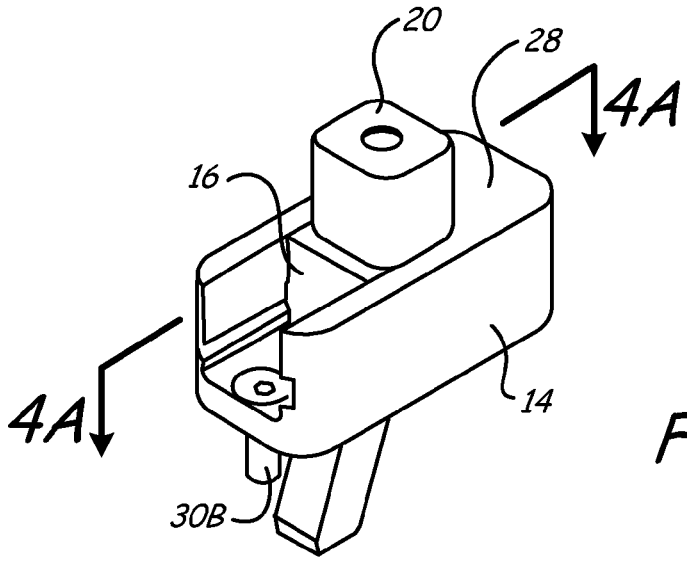
FIG. 3B shows a perspective view of an assembled slide assembly of FIG. 3A.

FIG. 3A shows an exploded view of slide assembly 10 of the present invention. FIG. 3B shows a perspective view of an assembled slide assembly 10 of FIG. 3A, and is discussed concurrently with FIG. 3A. Slide assembly 10 includes slide base 14, core slide 16, core pin 18, two-stage cam pin 20 and pin clamp 28. Slide base 14 is secured with movable die half 12 with, for example, threaded fasteners 30A and 30B. Core slide 16 includes rails 32A and 32B, which are slidably engagable in tracks 34A and 34B of slide base 14. Thus, core slide 16 is freely translatable along the length of slide base 14. Slide assembly 10 can also be equipped with lock pin 35 to lock the position of core slide 16 relative to slide base 14, such as during maintenance or other stoppages of a molding or casting system. Pin clamp 28 secures core pin 18 and is releasably engaged with core slide 16 such that different core pins can be easily introduced into slide assembly 10. In one embodiment, pin clamp 28 includes hook 36 for engaging flange 38 of core slide 16. Thus, core pin 18 translates as core slide 16 translates with respect to slide base 14.

Two-stage cam pin 20, which is secured with the stationary die half at head 40, is insertable into cam slot 42 of core slide 16 and through slide base 14. As movable die half 12 engages and withdraws from the stationary die half, cam pin 20 pushes and pulls against core slide 16, sliding it along tracks 34A and 34B of slide base 14. Thus, core pin 18 is translated in and out of cavity 22. Cam pin 20 comprises shank 44 including first shank portion 44A and second shank portion 44B. First shank portion 44A moves core slide 16 at a first rate and second shank portion 44B moves core slide 16 at a second rate. The two-stage cam action and dual-angle construction of cam pin 20 generates sufficient forces to break core pin 18 free from the solidified article in cavity 22 and to generate a large enough stroke such that core pin 18 can be inserted deeply into cavity 22, without causing destructive stresses in cam pin 20.

Figure 4A:
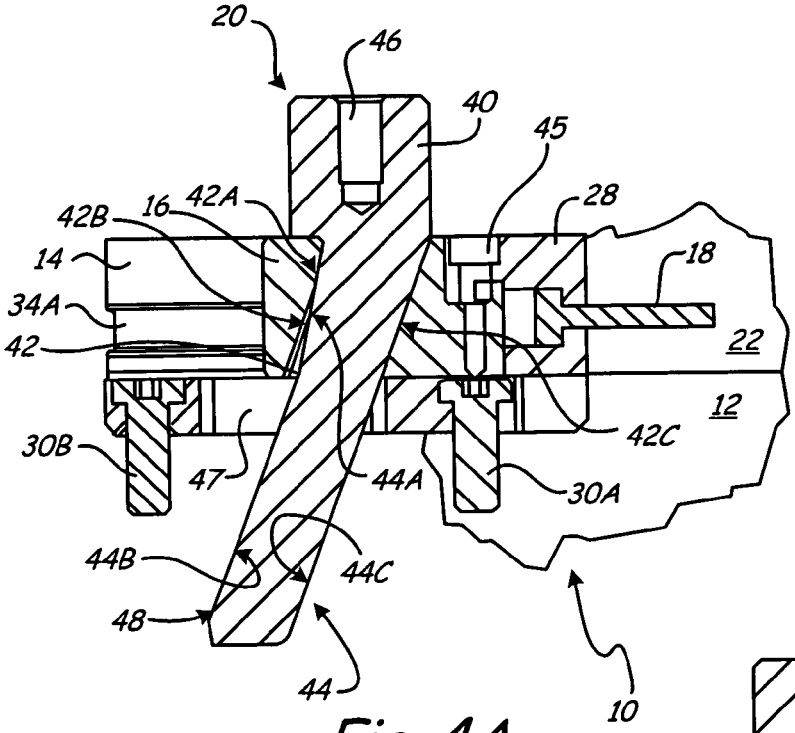
FIG. 4A shows a cross sectional view of the slide assembly of FIG. 3B with a cam pin inserted.

FIG. 4A shows cross section 4A-4A of FIG. 3B, illustrating the interaction of cam pin 20 and core slide 16. Slide base 14 is secured with movable die half 12 with threaded fasteners 30A and 30B and is therefore immobile with respect to the movable die half 12. Core slide 16 is slidably engaged with slide base 14 such that it freely moves horizontally (as shown in FIG. 4A) with respect to slide base 14 along rail 34A and rail 34B (not shown). Pin clamp 28 is secured to core slide 16 with, for example, a threaded fastener engagable with bore 45. Cam pin 20 is secured to the stationary die half at head 40 with, for example, a threaded fastener engagable with bore 46, and is therefore immobile with respect to core slide 16. In typical die casting and molding systems, movable die half 12 is movable transversely or vertically (as shown in FIG. 4A) with respect to the stationary die half. As such, slide base 14 and core slide 16 move with respect to the stationary die half in only the vertical direction. Because of this fixed relationship, a repeatable interaction between cam pin 20 and core slide 16 is produced as movable die half 12 engages and disengages the stationary die half. This interaction is used to insert and withdraw core pin 18 from cavity 22.

FIG. 4A shows slide assembly 10 as when the stationary die half is fully engaged with movable die half 12 such that cam pin 20 is fully inserted into cam slot 42 of core slide 16. Cam slot 42 includes first surface 42A, second surface 42B and third surface 42C. Shank 44 of cam pin 20 includes first portion 44A, second portion 44B and third portion 44C. When cam pin 20 is fully inserted into cam slot 42, third portion 44C of shank 44 is in contact with third surface 42C of slot 42. Second portion 44B of cam pin 20 does not, however, contact slot 42, first portion 44A does not contact first surface 42A, and second surface 42B does not contact shank 44, as typically some clearance is allowed for. Additionally, head 40 is in contact with core slide 16. Slide base 14 includes opening 47 such that shank 44 of slide base 14 is allowed to pass through slide base 14 and into pin slot 26. The length of shank 44 is determined, at least in part, by the distance that core pin 18 is desired to extend into cavity 22. Therefore, in other embodiments of the invention, shank 44 is shorter such that it does not extend through slide base 14 or core slide 16. Opening 47 is therefore optionally required, and slot 42 need not extend through core slide 16. Slide base 14 is fixedly positioned in movable die half 12 such that its rightmost edge (as shown in FIG. 4A) is adjacent die cavity 22. When cam pin 20 is fully inserted into core slide 16, core slide 16 is moved to its rightmost position such that the rightmost face of pin clamp 28 is flush with die cavity 22. As such core pin 18 is fully extended into die cavity 22.

During removal of cam pin 20 from core slide 16, such as when movable die half 12 is pulled downward from cam pin 20 (or if cam pin 20 were pulled upward from core slide 16), first portion 44A and second portion 44B of shank 44 interact with first surface 42A and second surface 42B to push core slide 16 (to the left as shown in FIG. 4A) such that core pin 18 is removed from cavity 22 in a two-stage action. First portion 44A and second portion 44B, and first surface 42A and second surface 42B interact to pull core slide 16 in a two-stage or dual-action manner such that enough force is generated to dislodge core pin 18 from the manufactured article, which has solidified around core pin 18, and with enough stroke to fully withdraw core pin 18 from cavity 22. Both of which are accomplished without excessively stressing cam pin 20. Conversely, as cam pin 20 is inserted into slot 42, such as during engagement of the stationary die half and movable die half 12, third portion 44C interacts with third surface 42C to push core slide 16 (to the right in FIG. 4A) such that core pin 18 is extended into cavity 22.

During initial removal of cam pin 20, first portion 44A first engages first surface 42A. First portion 44A of shank 44 extends from head 40 at a first angle with respect to head 40. Similarly, first surface 42A is inclined along slot 42 at an angle similar to that of the first angle. Therefore, first portion 44A pushes flush against first surface 42A during removal of cam pin 20. The first angle is oriented such that shank 44 slopes away from cavity 22 starting at head 40. Due to the inclined nature of the interaction, a leftward force is generated against core slide 16, which forces core slide 16 to travel along rail 34A and rail 34B (FIG. 3A). Core slide 16 pulls along pin 28, which begins to pull core pin 18 from cavity 22 such that it can be broken free of the solidified article.

An upward force is also generated against core slide 16 from first portion 44A, which produces a corresponding downward force on shank 44. Shank 44 is subjected to its greatest stresses when cam pin 20 begins its initial withdrawal from slot 42 due to the resistance from first surface 42A and the added resistance of core pin 18 being stuck within the manufactured article in cavity 22. In order to minimize the downward force on shank 44, which has the potential for fracturing shank 44, the first angle is at a shallow angle with respect to the major axis of cam pin 20 (a vertical axis in FIG. 4A). Thus, an upward movement of cam pin 20 produces only a small movement of core slide 16 in the leftward direction. Even though a steeper first angle would produce a larger leftward movement in core slide 16 (in other words, a larger stroke of cam pin 20), initially large movements are not of primary importance. Initially, in order to reduce the risk of fracturing shank 44, primary concern is to reduce stresses in shank 44. This is accomplished by configuring the angles of first portion 44A and second portion 44B such that shank 44 will first break core pin 18 from the manufactured article before producing large leftward movement of core slide 16. Core pin 18 is broken free after undergoing only a small leftward displacement, which can be provided by the shallow angle of first portion 44A. After which, stress in shank 44 decreases as the friction involved in pulling core pin 18 from the manufactured article correspondingly diminishes. Thus, the first angle is selected such that the primary source of stress in shank 44 originates from core pin 18 rather than first surface 42A and core slide 16.

Cam pin 20 moves core slide 16 at a reduced ratio to that at which the stationary die half moves cam pin 20. Cam pin 20 typically reduces the ratio proportional to the angle at which first portion 44A forms with a transverse axis of shank 44. For example, a straight shank having an angle of zero degrees with respect to the transverse axis of shank 44 would reduce the ratio to zero. A shank having an angle of forty-five degrees would reduce the ratio by half, thus if stationary die half moved an inch, core slide 16 would move a half inch. Core slide 16 continues to move at the ratio or rate of movement provided by first portion 44A until an inflection point is reached, at which shank 44 can function to withdraw core pin 18 at a higher ratio such that core pin 18 is withdrawn a greater distance, with a reduced risk of fracture. At the inflection point, second portion 44B begins to engage second surface 42B, and first portion 44A begins to disengage second surface 42A.

Second portion 44B of shank 44 extends from first portion 44A and extends relative to head 40 at a second angle. Similarly, second surface 42B is inclined along slot 42 at an angle similar to that of the second angle. Therefore, second portion 44B pushes flush against second surface 42B during removal of cam pin 20. The second angle is oriented such that shank 44 slopes away from cavity 22 starting at head 40. As such, a continuous leftward force is generated against core slide 16 when transitioning at the inflection point. The second angle is, however, steeper than the first angle with respect to the major or transverse axis of cam pin 20 such that the rate of removal of core pin 18 from cavity 22 is increased with respect to the withdrawal rate of cam pin 20. In other words, for a given upward movement of cam pin 20, second portion 44B produces a larger leftward movement of core slide 16 than first portion 44A would move core slide 16 with the same movement of cam pin 20. Thus, a longer length of core pin 18 can be removed from cavity 22 than if shank 44 were inclined entirely at the first angle. Due to the steeper angle of the second angle as compared to the first angle, a larger downward force is produced against shank 44 as compared to that of the first angle. Since, however, core pin 18 is already broken free of the manufactured article, less stress is generated in shank 44 and the risk of fracturing shank 44 is reduced. As cam pin 20 is fully withdrawn from slot 42, second portion 44B continues along second surface 42B until tip 48 clears opening 47. Tip 48 then continues along second surface 42B and first surface 42A until cam pin 20 is fully withdrawn, continuously pushing core slide 16 along rails 34A and 34B until core pin 18 is withdrawn from cavity 22.

Figure 4B:
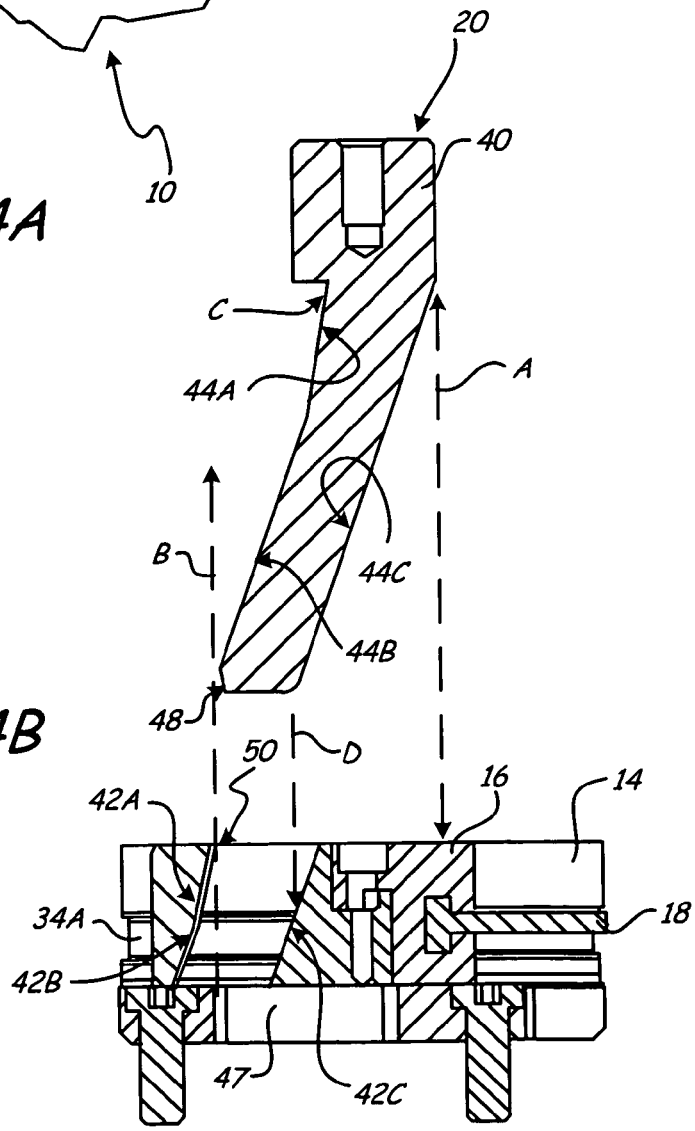
FIG. 4B. shows a cross sectional view of the slide assembly of FIG. 4A with the cam pin removed.

FIG. 4B shows cam pin 20 fully removed from slot 42 of core slide 16. Cam pin 20 travels straight up and down with respect to slide base 14, as represented by arrow A. After cam pin 20 has been removed from core slide 16, tip 48 of cam pin 20 is approximately aligned with tip 50 of core slide 16, as indicated by arrow B. Additionally, tip 48 is approximately aligned with opening 47 such that it clears opening 47 upon reinsertion. Core slide 16 is translated along rail 34A such that pin clamp 28 is pulled away from the rightmost edge of slide base 14. Additionally, core pin 18 is retracted to within the rightmost edge of slide base 14. Core slide 16 and core pin 18 are translated a distance equal to approximately the length between the juncture between head 40 and first portion 44A (indicated at arrow C), and tip 48, which is the stroke of shank 44. Thus, for the shown embodiment, the distance core pin 18 can extend beyond the rightmost surface of pin clamp 28 is approximately equal to the stroke of shank 44. However, if the rightmost edge of slide base 14 were not aligned with cavity 22, core pin 18 could extend beyond the rightmost edge of pin clamp 28. Conversely, core pin 18 may extend less than the stroke of shank 44. In any case, core pin 18 does not extend into cavity 22 beyond a distance approximately equal to the stroke of shank 44.

After cam pin 20 has been removed from core slide 16, and the manufactured article has been removed, cavity 22 is ready to begin the process of fabricating another article. Thus, movable die half 12 must be brought back into engagement with the stationary die half, and core pin 18 must be reinserted into cavity 22. Slide assembly 10 works to extend core pin 18 back into cavity 22 as moveable die half 12 is brought into contact with the stationary die half.

As movable die half 12 is brought toward the stationary die half, cam pin 20 is brought toward slot 42, as shown by arrow D. Third portion 44C of shank 44 is brought into contact with third surface 42C of slot 42. Third portion 44C travels along third surface 42C as it pushes core slide 16 to the right (as shown in FIG. 4B). Additionally, tip 48 of shank 44 is chamfered to permit shank 44 to pass by tip 50 of core slide 16, particularly in the event of any misalignment. When cam pin 20 is fully seated, tip 48 has passed through opening 47 and third portion 44C is flush against third surface 42C. In one embodiment, third portion 44C forms an angle with respect to head 40 approximately equal to the second angle, and third surface 42C is inclined on slot 42 at approximately the same angle. Since cam shank 44 does not have to break core pin 18 free during reinsertion of cam pin 20, third portion 44C and third surface 42C need only provide a single-stage or single mode cam action to core pin 18 into cavity 22. Third portion 44C and third surface 42C are angled such that core pin 18 is fully extended back into cavity 22.

With the stationary die half pressing down on movable die half 12, cam pin 20 is also firmly engaged with core slide 16. Cam pin 20 provides stiff resistance to leftward movement of core slide 16 during a casting or molding process. Thus, core pin 18 is held firmly in place during casting or molding operations such that core pin 18 produces a highly repeatable and accurate void in every article formed in cavity 22. Thus, after each article is manufactured, cam pin 20 is again removed from core slide 16 using the two-stage cam action provided by shank 44. Due to the stress saving characteristics of shank 44, the life of shank 44 is extended and the potential for breakage of shank 44 is reduced. Also, the two-stage cam action of shank 44 allows for core pins of greater length to be inserted into cavity 22. Thus, larger voids can be produced within the manufactured articles, greatly enhancing the flexibility of molding and casting systems implementing slide assembly 10.

Figure 5A:
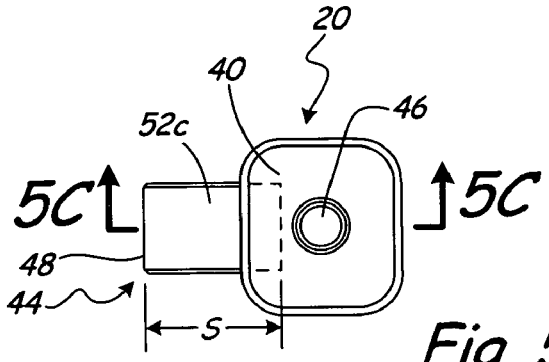
FIG. 5A shows a top view of the cam pin of FIGS. 4A and 4B.
Figure 5B:
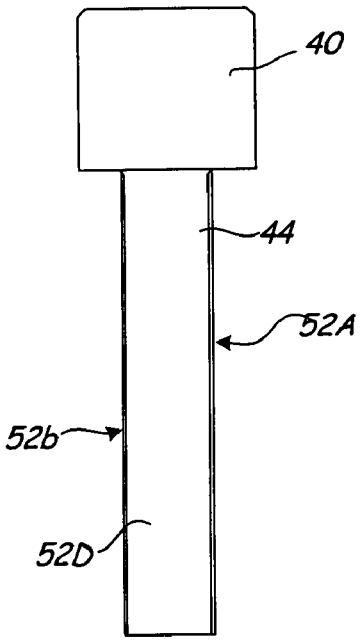
FIG. 5B shows a side view of the cam pin of FIG. 5A.
Figure 5C:
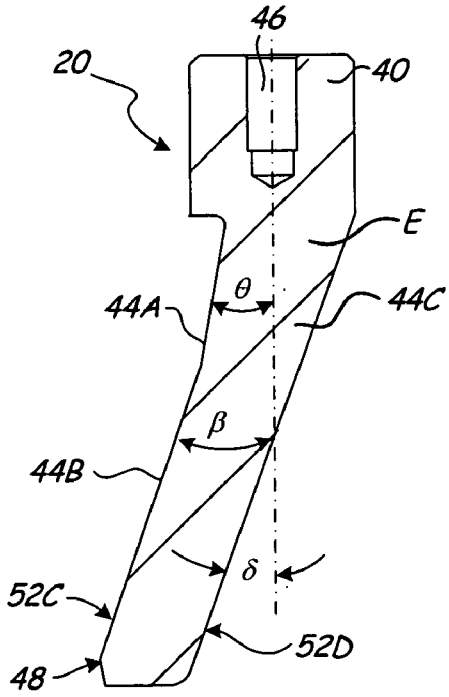
FIG. 5C shows cross section 5C-5C of the cam pin from FIG. 5A.

FIG. 5A shows a top view of cam pin 20. FIG. 5B shows a front view of cam pin 20. FIG. 5C shows cross section 5C-5C of cam pin 20 from FIG. 5A. Two-stage shank 44 extends generally transversely from head 40, but is, however, inclined such that it interacts with core slide 16. Two-stage shank 44 includes left and right sides 52A and 52B, back side 52C and front side 52D. Left and right sides 52A and 52B of shank 44 are generally parallel and extend generally perpendicularly from the bottom of head 40. The length between left side 52A and right side 52B, the width of shank 44, is such that shank 44 will fit within cam slot 42 and opening 47 of core slide 16.

Back side 52C of cam pin 20 is inclined with respect to the bottom of head 40 and slopes generally away from front side 52D. Back side 52C includes the rearmost parts of first portions 44A and 44C. First portion 44A extends from head 40 and forms angle θ with respect to transverse axis E of cam pin 20. Second portion 44B extends from first portion 44A and forms angle β with respect to transverse axis E of cam pin 20. Angle θ and angle β extend obliquely with respect to axis E such that they are not parallel to axis E. Angle θ and angle β together provide cam shank 44 with a two-stage cam action allowing cam pin 20 to drive or push core slide 16 at two rates or in two modes. When the stationary die half drives cam pin 20 transversely, e.g. along axis E, first portion 44A drives core slide 16 laterally at a corresponding reduced ratio approximately equal to that of the cosine of angle θ[cos(θ)]. Second portion 44B drives core slide 16 at a ratio proportional to the cosine of angle β[cos(β)]. Angle β is typically greater than angle θ, and in one embodiment angle β is approximately ten degrees and angle θ is approximately twenty degrees. Thus, first portion 44A provides slight movement of core slide 16 until core pin 18 is broke free, and second portion 44B provides greater motion of core slide 16 such that core pin 18 can be fully withdrawn from cavity 22.

Angle θ and angle β work to extend tip 48 on back side 52C backwards past head 40 a distance S. Distance S is the stroke of cam pin 20 and defines a distance that core pin 18 can be retracted or otherwise translated using slide assembly 10. The stroke of cam pin 20 is thus controlled by angle θ and angle β. As such, angle θ and angle β can be selected to provide the desired stroke based upon the die casting or molding system in which slide assembly 10 is to be used. Slide assembly 10 can be scaled up or down in size for use in larger or smaller systems, with angle θ and angle β varying accordingly. Slide assembly 10 is, however, particularly useful in smaller injection molding systems where slide assemblies with large strokes are difficult to achieve due to the increased likelihood of fracturing the cam pin. For example, a stroke of about 0.25 inches (~0.635 cm) is considered to be large for small-scale injection molding. With the two-stage cam action of cam pin 20, one embodiment of the present invention is able to achieve a stroke of about 0.375 inches (~0.953 cm) for small-scale injection molding systems.

Front side 52D is inclined with respect to the bottom of head 40 and slopes generally toward back side 52C of cam pin 20. Front side 52D is generally flat such that it engages flush with third surface 42C of core slide 16. The forward most portion of shank 44 defines third portion 44C. Third portion 44C extends from head 40 and forms δ with respect to transverse axis E of cam pin 20. In one embodiment, angle δ is approximately equal to angle β. Front side 52D, third portion 44C and angle δ work with third surface 42C to push core pin 18 fully back into position inside cavity 22.

Figure 6A:
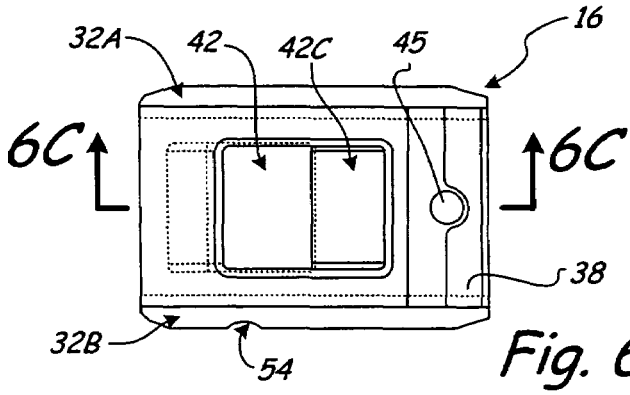
FIG. 6A shows a top view of a core slide of FIGS. 4A and 4B.
Figure 6B:
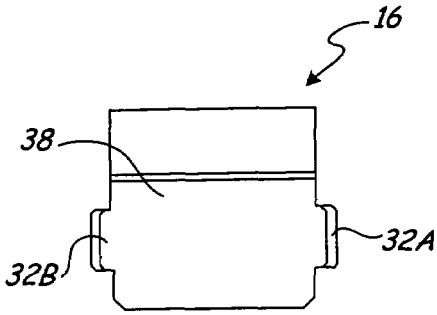
FIG. 6B shows a side view of the core slide of FIG. 6A.
Figure 6C:
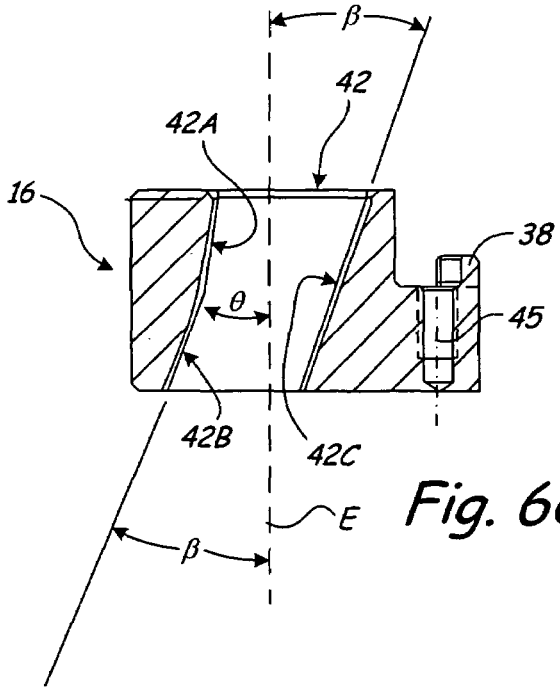
FIG. 6C shows cross section 6C-6C of the core slide from FIG. 6A.

FIG. 6A shows a top view of core slide 16 of FIGS. 4A and 4B. FIG. 6B shows a side view of core slide 16. FIG. 6C shows cross section 6C-6C of core slide 16 from FIG. 6A. Core slide 16 is resealably connected with pin clamp 28 through hook 38 such that core slide 16 is connected with core pin 18. Pin clamp 28 is secured to core slide 16 through a threaded fastener engaged in bore 45. Core slide 16 is slidably engagable with slide base 14 utilizing rails 32A and 32B. Rail 32A includes notch 54, which can be used in conjunction with a lock pin 35, or some other detent, to lock the position of core slide 16 relative to slide base 14. Rails 32A and 32B translate along tracks 34A and 34B of slide base 14 as cam pin 20 engages core slide 16.

Cam pin 20 moves transversely to core slide 16 along axis E (corresponding to axis E of FIG. 5C), such that cam pin 20 engages cam slot 42. Cam slot 42 is positioned generally in the center of core slide 16 and includes a beveled top edge to facilitate easier insertion of cam pin 20. Cam slot 42 includes first surface 42A, second surface 42B and third surface 42C, which interact with first portion 44A, second portion 44B and third portion 44C of cam shank 44 to move core slide 16 in a two-stage motion. First surface 42A is inclined with respect to axis E and is disposed at an angle similar to that of angle θ. Thus, first surface 42A engages flush with first portion 44A of shank 44 to translate core slide 16 at a first rate as cam pin 20 is initially pulled out of core slide 16. Second surface 42B is inclined with respect to axis E and is disposed at an angle similar to that of angle β. Thus, second surface 42A engages flush with second portion 44B of shank 44 to translate core slide 16 at a second rate as cam pin is finally withdrawn from core slide 16.

During insertion of cam pin 20 into core slide 16, third surface 42C engages with third portion 44C of cam shank 44. Third surface 42C is inclined with respect to axis E and is disposed at n angle similar to that of third portion 44C, which, in one embodiment, is approximately that of angle β. Thus, third surface 42C engages flush with third portion 44C to translate core slide 16 at a continuous rate as cam pin is inserted into cam slot 42.

Figure 7A:
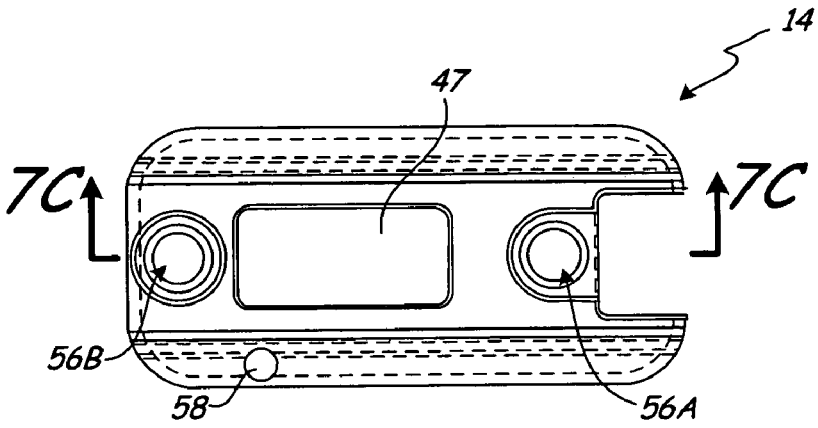
FIG. 7A shows a top view of a slide base of FIGS. 4A and 4B.
Figure 7B:
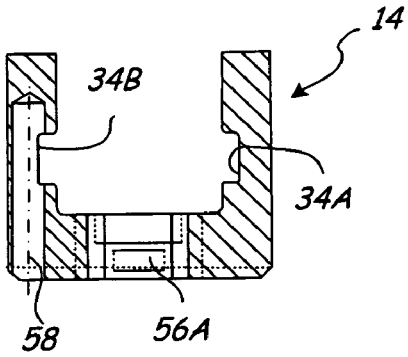
FIG. 7B shows a side view of the slide base of FIG. 7A.
Figure 7C:
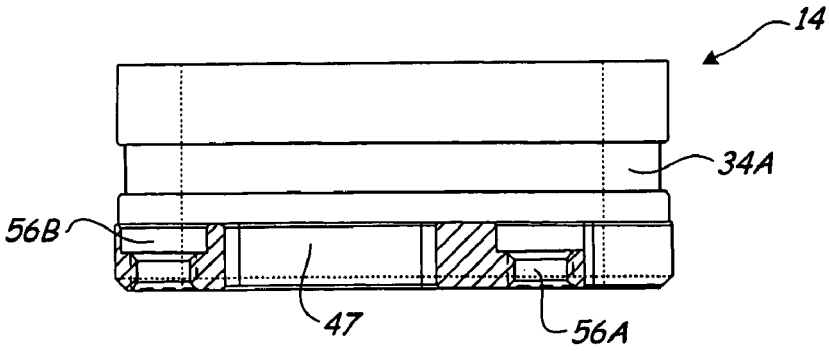
FIG. 7C shows cross section 7C-7C of the slide base from FIG. 7A.

FIG. 7A shows a top view of slide base 14 of FIGS. 4A and 4B. FIG. 7B shows a side view of slide base 14 of FIG. 7A. FIG. 7C shows cross section 7C-7C of slide base 14 from FIG. 7A. Slide base 14 is secured to movable die half 12 with, for example, threaded fasteners engaged with bores 56A and 56B. Slide base 14 includes opening 47 to allow for passage of shank 44 of cam pin 20 through slide base 14. Slide base 14 also includes bore 58 for receiving lock pin 35 such that core slide 16 can be immobilized with respect to slide base 14. Bore 58 extends into slide base 14 through track 34B such that lock pin 35 can engage notch 54 of rail 32B. Tracks 34A and 34B run along opposing interior surfaces of slide base 14 such that they are engagable with rails 32A and 32B of core slide 16. Tracks 34A and 34B provide a smooth, unencumbered pathway on which rails 32A and 32B can slide as cam pin 20 drives core slide 16. Slide base 14 is typically wide enough to accommodate the entire stroke of cam pin 20 without derailing core slide 16.

The components of slide assembly 10, including slide base 14, core slide 16, core pin 18, and pin clamp 28, can be made of any material suitable for either injection molding or die casting. Typically, high strength, heat resistant tool steels such as H-13, S-7 or equivalent are used.

Although the present invention has been described with reference to preferred embodiments, workers skilled in the art will recognize that changes may be made in form and detail without departing from the spirit and scope of the invention.

The invention claimed is:

1. A slide assembly for use in a molding or casting system, the slide assembly comprising:

a cam pin comprising:

a head for securing with a first die half; and a two-stage shank extending from the head;

a slide base mountable to a second die half; and a core slide slidably engaged with the slide base, the core slide comprising:

a core pin for extending into a die cavity of the molding or casting system; and a cam pin slot for receiving the two-stage shank of the cam pin such that unidirectional one-speed motion between the cam pin and the slide base in a first direction produces unidirectional two-speed motion between the core slide and the slide base in a second direction, the two-speed motion producing two positive displacements of the core slide in the second direction.

2. The slide assembly of claim 1 wherein:

the two-stage cam pin further comprises:

a first shank portion extending from the head and forming a first oblique angle with respect to a transverse axis extending through the head; and a second shank portion extending from the first shank portion to a tip of the cam pin to form a second oblique angle with respect to the transverse axis that is less transverse to the cam pin than the first oblique angle; and the cam pin slot further comprises a first surface inclined at about the first oblique angle and a second surface inclined at about the second oblique angle;

wherein during transverse removal of the cam pin from the cam pin slot from the head to the tip, the first shank portion interacts with the first surface to translate the core slide laterally at a first rate and the second shank portion interacts with the second surface to translate the core slide laterally at a second rate higher than the first rate.

3. The slide assembly of claim 2 wherein the cam pin slot further includes a third surface facing toward the first surface and the second surface and inclined at about the second oblique angle for interacting with a third shank portion extending at a uniform oblique angle from the head to the tip on an opposite side of the cam pin as the first and second shank portions.

4. The slide assembly of claim 3 wherein the third portion of the two-stage shank engages the third surface of the cam pin slot and produces a one-speed lateral motion of the core slide in a third direction opposite the second direction as the cam pin is inserted transversely into the core slide from the tip to the head.

5. The slide assembly of claim 1 wherein the two-stage shank of the cam pin includes:

a first portion for producing a first lateral speed of the core slide when the cam pin is transversely withdrawn from the core slide; and a second portion for producing a second lateral speed of the core slide when the cam pin is transversely withdrawn from the core slide;

wherein the second lateral speed is greater than the first lateral speed.

6. The slide assembly of claim 1 wherein the two-stage shank of the cam pin extends laterally from the head to the tip to define a stroke, wherein the stroke defines a distance the core pin is withdrawable from a casting or molding cavity.

7. The slide assembly of claim 6 wherein the two-stage shank of the cam pin includes:

a first portion inclined at a first angle for traversing the core slide in order to dislodge the core pin from a molded or cast article with reduced stress in the shank; and a second portion inclined at a second angle for traversing the core slide in order to withdraw the core pin from a molding or casting cavity a distance equal to the stroke.

8. The slide assembly of claim 6 wherein the stroke is defined by first and second inclinations of the two-stage shank such that the cam pin is translated in two modes.

9. The slide assembly of claim 6 wherein the tip is chamfered such that the shank is insertable into the cam pin slot.

10. The slide assembly of claim 1 wherein the core slide includes a pin clamp portion such that the core pin is releasably attached to the core slide.

11. The slide assembly of claim 1 wherein the core slide includes a lock pin such that the core pin is immobilized with respect to the core slide.

12. A slide assembly for use in a molding or casting system, the slide assembly comprising:

a cam pin comprising:

a head for securing with a first die half, the head extending along a transverse axis; and a cam shank comprising:

a first portion extending from the head and having a first oblique angle relative to the transverse axis of the head; and a second portion extending from the first portion to a tip of the cam pin and having a second oblique angle relative to the transverse axis of the head;

a slide base mountable to a second die half;

a core slide slidably engaged with the slide base to translate in a lateral direction, the core slide comprising:

a core pin for extending into a die cavity of the molding or casting system; and a cam pin slot for receiving the first shank portion and second shank portion of the cam pin;

wherein during transverse removal of the cam pin from the core slide, the first portion engages the cam pin slot to translate the core slide laterally at a first rate and the second portion engages the cam pin slot to translate the core slide laterally at a second rate.

13. The slide assembly of claim 12 wherein the first oblique angle is more transverse to the transverse axis of the cam pin head than the second oblique angle.

14. The slide assembly of claim 13 wherein the cam pin slot includes a first surface inclined at about the first oblique angle to engage the first portion and a second surface inclined at about the second oblique angle to engage the second portion, wherein during removal the core slide is positively translated in a first direction as the cam pin is translated across the first and second surfaces from the head to the tip.

15. The slide assembly of claim 14 wherein the cam pin includes a third portion extending from the head to the tip at a uniform third oblique angle relative to the transverse axis of the head on an opposite side of the cam pin as the first and second shank portions, and the cam pin slot includes a third surface facing toward the first and second surfaces inclined at about the third oblique angle.

16. The slide assembly of claim 15 wherein the third portion of the cam shank engages the third surface of the cam pin slot and produces a one-speed lateral motion of the core slide in a second direction opposite the first direction as the cam pin is inserted transversely into the core slide from the tip to the head.

17. The slide assembly of claim 12 wherein:

the first portion is for producing a first lateral speed of the core slide when the cam pin is transversely withdrawn from the core slide; and the second portion is for producing a second lateral speed of the core slide when the cam pin is transversely withdrawn from the core slide;

wherein the second lateral speed is greater than the first lateral speed.

18. The slide assembly of claim 12 wherein the cam shank of the cam pin extends laterally from the head to define a stroke, wherein the stroke defines a distance the core pin is withdrawable from a casting or molding cavity.

19. The slide assembly of claim 18 wherein:

the first oblique angle is for traversing the core slide in order to dislodge the core pin from a molded or cast article without fracturing the shank; and the second oblique angle is for traversing the core slide in order to withdraw the core pin from a molding or casting cavity a distance equal to the stroke.

* * * * *

UNITED STATES PATENT AND TRADEMARK OFFICE

CERTIFICATE OF CORRECTION

PATENT NO. : 7,637,305 B2
APPLICATION NO. : 11/516959
DATED : December 29, 2009
INVENTOR(S) : Richard L. Dubay It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 673 days.

Signed and Sealed this

Ninth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,637,305 B2
APPLICATION NO. : 11/516959
DATED : December 29, 2009
INVENTOR(S) : Richard L. Dubay It is certified that error appears in the above-identified patent and that said Letters Patent is hereby corrected as shown below:

Col. 12, Line 20
Delete " "
Insert -- the tip to -- after "from the head to"

Signed and Sealed this
Seventh Day of June, 2011

David J. Kappos

David J. Kappos
*Director of the United States Patent and Trademark Office*